US006163928A

United States Patent [19]

Chung

[11] Patent Number: 6,163,928

[45] Date of Patent: Dec. 26, 2000

[54] HINGE DEVICE FOR CASING

[75] Inventor: Ki-keun Chung, Suwon, Rep. of Korea

[73] Assignee: Tae Woo Precision Ltd., Rep. of Korea

[21] Appl. No.: 09/158,857

[22] Filed: Sep. 23, 1998

[30] Foreign Application Priority Data

Jul. 11, 1998 [KR] Rep. of Korea ..... 98-12804

[51] Int. Cl.[7] ..... E05C 7/04

[52] U.S. Cl. ..... 16/342; 16/337; 361/681

[58] Field of Search ..... 16/337, 342, 374; 403/146; 361/681

[56] References Cited

U.S. PATENT DOCUMENTS

| | | | |
|---|---|---|---|
| 4,018,104 | 4/1977 | Bland et al. | 403/146 |
| 4,192,622 | 3/1980 | Stecklein | 403/146 |
| 5,109,570 | 5/1992 | Okada et al. | 16/342 |
| 5,702,197 | 12/1997 | Chen | 16/342 |
| 5,772,351 | 6/1998 | Ching | 16/337 |
| 5,867,872 | 2/1999 | Katoh | 16/337 |
| 5,894,633 | 4/1999 | Kaneko | 16/337 |

FOREIGN PATENT DOCUMENTS

| | | | |
|---|---|---|---|
| 708574 | 5/1954 | United Kingdom | 403/146 |

*Primary Examiner*—Anthony Knight
*Attorney, Agent, or Firm*—Orum & Roth

[57] ABSTRACT

A hinge device is provided. In the hinge device including a flange, a shaft portion having a shaft having a diameter equal or smaller than that of the flange, a supporting portion through which the shaft portion inserts into rotatably, a stopper rotating together with the shaft for restricting the degree of rotation of the supporting portion and at least one first spring portion for applying an elastic force against the supporting portion are located between the flange and the supporting portion, and at least one second spring to apply elastic force against the supporting portion and a washer to prevent the nut from being loosened are located between the nut and the supporting portion.

4 Claims, 6 Drawing Sheets

HINGE DEVICE FOR CASING

BACKGROUND OF THE INVENTION

1. Field of the Invention

The present invention relates to a hinge device for a casing.

2. Description of the Related Art

A hinge device is widely used to combine two parts that are rotatable with respect to each other. A hinge device suitable for combining a computer monitor with a stand that supports the monitor to be rotatable with respect to each other. The hinge device includes a shaft portion 10, a supporter 20, and springs 30.

The shaft portion 10 includes a flange 11 and a shaft 12 and a fixing portion 13 provided on both sides of the flange 11. The shaft 12 includes a circular section 12*a* adjacent to the flange 11 and a combining portion 12*b* extended from the circular section 12*a* and processed to have a non-circular section. The fixing portion 13 is fixed to either a monitor or a stand.

The supporter 20 through which the circular section 12*a* of the shaft 12 is inserted includes a fixing portion 22 to be fixed to either the monitor or the stand and a restrain projection 23.

The springs 30 which are all convex belleville springs are elastically transformed in a longitudinal direction of the shaft 12 by a nut 40 which combines with the shaft 12. As mentioned above, the elastically transformed springs 30 apply an elastic force on the supporter 20 to the flange 11 of the shaft portion 10. Accordingly, frictional torque for suppressing the rotation of the supporter 20 with respect to the shaft portion 10 by a force is generated between the shaft portion 10 and the supporting portion 20.

Washers 50 and 60 having holes 51 and 61 for receiving oil lubricant are installed on both sides of the supporting portion 20. A stopper 70 having a combining hole 71 and a stopper protrusion 72 is installed between the spring 30 and the nut 40. The combining hole 71 has an opening corresponding to the combining portion 12*b* so that the rotation of the stopper 70 with respect to the shaft portion 10 can be prevented.

In the hinge device, the supporting portion 20 can rotate with respect to the shaft portion 10 only when a torque larger than the frictional torque provided by the springs 30 is applied between the shaft portion 10 and the supporting portion 20. Therefore, for example, when the supporting portion 20 is fixed to the monitor and the shaft portion 10 is fixed to the stand, it is possible to prevent the supporting portion 20 from arbitrarily rotating together with the monitor by the weight of the monitor. When the supporting portion 20 is rotated with respect to the shaft portion 10 by applying a torque larger than the frictional torque, the rotation is performed smoothly due to the oil lubricant in the through holes 51 and 61. When the supporting portion 20 rotates by a predetermined degree with respect to the shaft portion 10, as shown in FIG. 3 by the dashed line, the stopper protrusion 72 is caught in the restrain projection 23. Thus, further rotation is prevented.

In a conventional hinge device having the above structure, washers having through holes are provided on both sides of the supporting portion so that the rotation of the supporting portion with respect to the shaft is performed smoothly and the oil lubricant is received in the through holes of the washers. Therefore, the overall structure and assembly process becomes complicated due to the washers.

SUMMARY OF THE INVENTION

To solve the above problems, it is an object of the present invention to provide a hinge device having a simplified structure by reducing the number of parts and so that the supporting portion rotates smoothly.

Accordingly, to achieve the above object, there is provided a hinge device comprising a flange, a shaft portion having a shaft having a diameter equal or smaller than that of the flange, a supporting portion through which the shaft portion inserts into rotatably, wherein a stopper rotating together with the shaft for restricting the degree of rotation of the supporting portion and at least one first spring portion for applying an elastic force against the supporting portion are located between the flange and the supporting portion, and wherein at least one second spring to apply elastic force against the supporting portion and a washer to prevent the nut from being loosened are located between the nut and the supporting portion.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
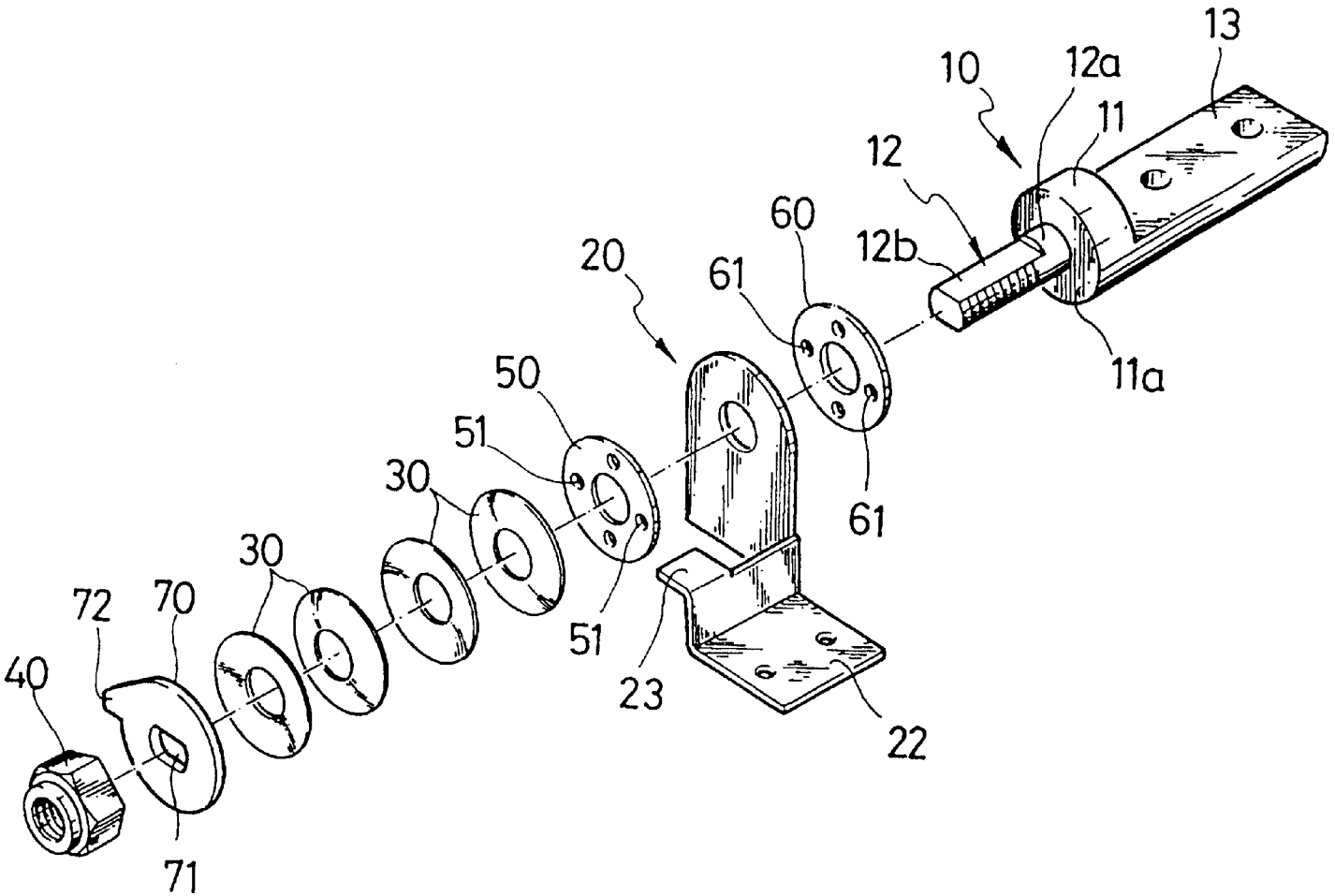
FIG. 1 (PRIOR ART)
FIG. 1 is a perspective view of a conventional hinge device.
Figure 2:
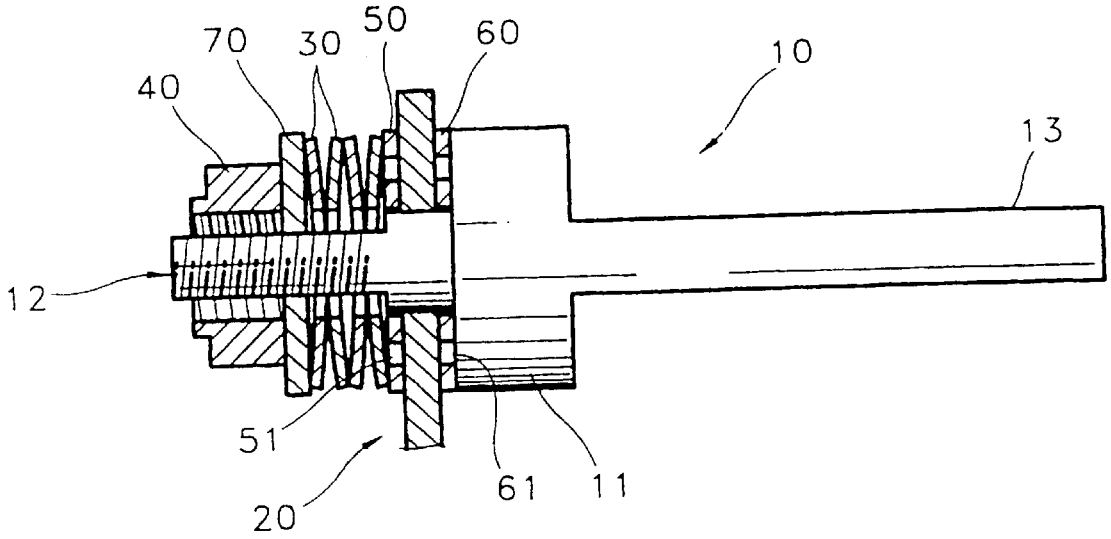
FIG. 2 (PRIOR ART)
FIG. 2 is a sectional view showing a part of the hinge device of FIG. 1.
Figure 3:
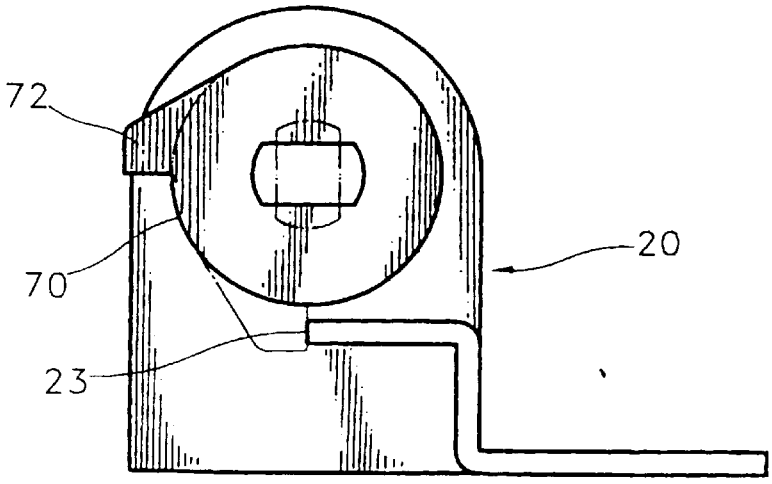
FIG. 3 (PRIOR ART)
FIG. 3 is a schematic side view of the hinge device of FIG. 1.
Figure 4:
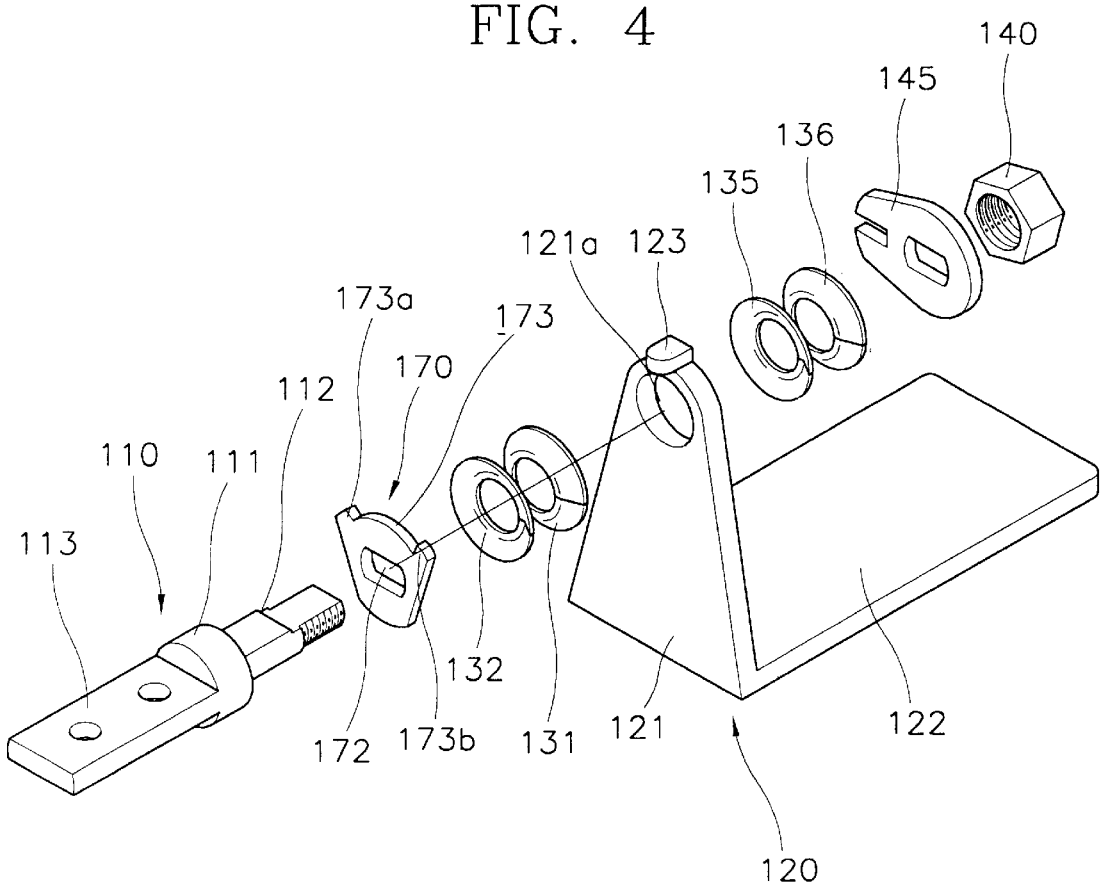
FIG. 4 is a perspective view of a first embodiment of a hinge device according to the present invention.
Figure 6:
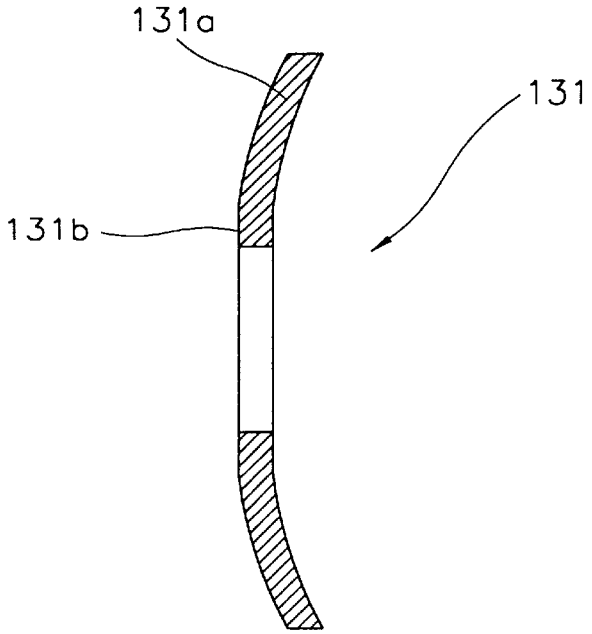
FIG. 6 is a side sectional view of a spring of FIG. 5.
Figure 7:
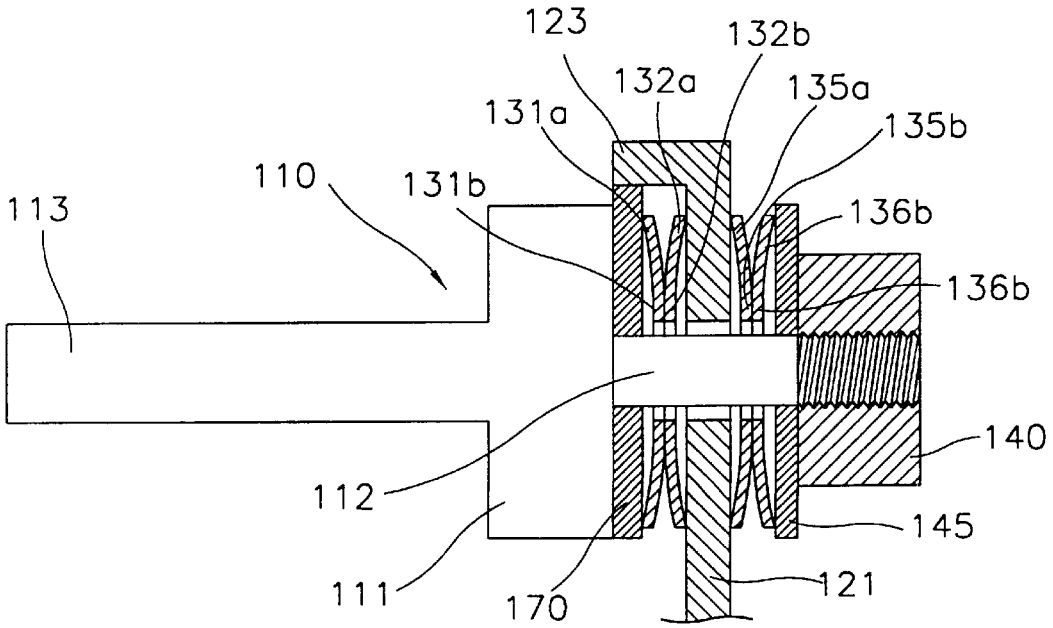
FIG. 7 is a side view of the hinge device of FIG. 4.

Referring to FIGS. 4 and 6, the hinge device of the first embodiment includes a shaft portion 110, a supporting portion 120, and a nut 140 which prevents the shaft portion 110 from separating from the supporting portion 120.

A flange portion 111 and a shaft 112 provided on one side of the flange 111 and having a diameter smaller than that of the flange portion 111 are provided in the shaft portion 110. The shaft 112 is processed to have a non-circular section. A fixing portion 113 for combining the flange 111 with predetermined parts is included on the other side of the flange 111.

The shaft 112 of the shaft portion 110 inserts into the supporting portion 120. The supporting portion 120 includes a rotating portion 121 having a hole 121*a* into which the shaft 112 is inserted and a fixing portion 122. The parts supported to be rotatable with respect to the parts fixed to the fixing portion 113 of the shaft portion 110 are fixed to the fixing portion 122. Also, a stopper protrusion 123 caught in a groove 173 of a stopper 170 to be mentioned later is formed in the supporting portion 120.

First springs 131 and 132 and second springs 135 and 136 are inserted around the shaft 112, interposing the rotating portion 121 between the first and second springs 131 and 135. The nut 140 locked to the shaft 112 elastically transforms the springs in a longitudinal direction of the shaft 112 and prevents the springs from drifting away from the shaft 112.

The stopper 170 for restricting the degree of rotation of the supporting portion 120 is installed between the flange 111 and a first spring 132. A through hole 172 having a non-circular section is formed in the stopper 170 so that the non-circular section of the shaft 112 inserts into the through hole 172. The stopper 170 is rotated together with the shaft 112 inserted into the through hole 172. A groove 173 in which the stopper protrusion 123 of the rotating portion 121 is located is formed in the stopper 170. The degree of rotation of the stopper protrusion 123 is restricted by the stopper protrusion 123 caught in the groove 173.

The two first springs 131 and 132 located between the stopper 170 and the rotating portion 121 of the supporting portion 120 and the two second springs 135 and 136 located between the rotating portion 121 and the nut 140 apply an elastic force on the supporting portion 120 from both sides.

Figure 5:
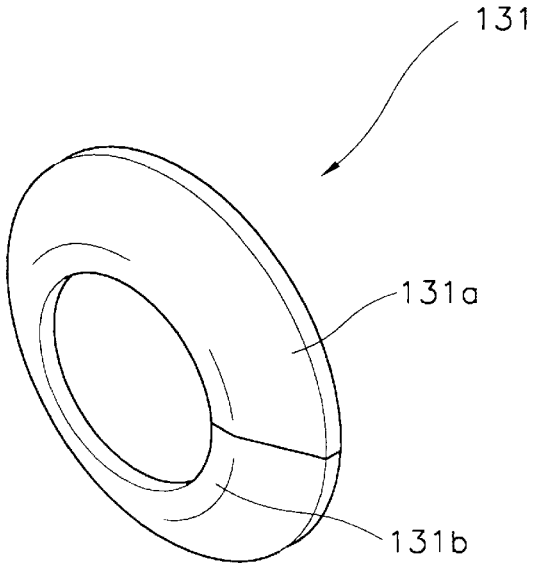
FIG. 5 is a perspective view of a spring used in the hinge device of FIG. 4.

The first spring 131 is taken as an example among the first and second springs 131 and 132 and 135 and 136. The first spring 131 is an entirely convex belleville spring as shown in FIGS. 5 and 6. The convex belleville spring is comprised of a plane portion 131*b* in the uppermost portion and an edge portion 131*a* curved from the plane portion 131*b*. The springs 131 and 132 are located so that the plane portions 131*b* and 132*b* oppose and contact each other. Namely, with the plane portions 131*b* and 132*b* attached to each other, the edge portion 131*a* of the spring 131 contacts one side of the rotating portion 120. The edge portion 132*a* of the spring 132 contacts the stopper 170. With the plane portions 135*b* and 136*b* of the second springs 135 and 136 opposite and contacting each other, the edge portion 135*a* of the spring 135 contacts the other side of the rotating portion 121. The edge portion 136*a* of the spring 136 contacts one side of a washer 145 to prevent the nut 140 from being untied.

Also, it is preferable that oil lubricant having high viscosity is received in the inside of the first and second springs. The oil lubricant seeps between the plane portions 131*b* and 132*b* and 135*b* and 136*b* and makes the rotation of the springs smooth.

In the hinge device having such a structure, the supporting portion 120 is elastically pressurized by the first springs 131 and 132 and second springs 135 and 136 elastically transformed in the longitudinal direction of the shaft 112. Due to the elastic force, a frictional torque for suppressing rotation of the supporting portion 120 with respect to the shaft portion 110 is generated between the shaft portion 110 and the supporting portion 120. Therefore, when a torque smaller than the frictional torque is applied to the shaft portion 110 or the supporting portion 120, the supporting portion 120 cannot rotate relative to the shaft portion 110. Accordingly, it is possible to prevent the supporting portion 120 from easily rotating to an undesired position due to a small external force and the weight of the monitor. When a torque larger than the frictional torque is applied to the shaft portion 110 or the supporting portion 120, the supporting portion 120 overcomes the frictional torque and rotates with respect to the shaft portion 110.

When the supporting portion 120 rotates a predetermined amount with respect to the shaft portion 110, the stopper protrusion 123 of the supporting portion 120 is caught in one of the restrain projections 173*a* and 173*b* at the ends of the groove 173 of the stopper 170, thus preventing the supporting portion 120 from further rotating with respect to the shaft portion 110.

In the hinge device according to the present invention, the washers are not necessary as in the conventional hinge device. First springs 131 and 132 and second springs 135 and 136 are respectively installed on one side and the other side of the supporting portion 120 for smooth rotation of the supporting portion 120 with respect to the shaft portion 110. Therefore, the overall structure of the hinge device according to the present embodiment is simplified. Accordingly, it is possible to reduce manufacturing costs and to simplify the assembly process.

Figure 8:
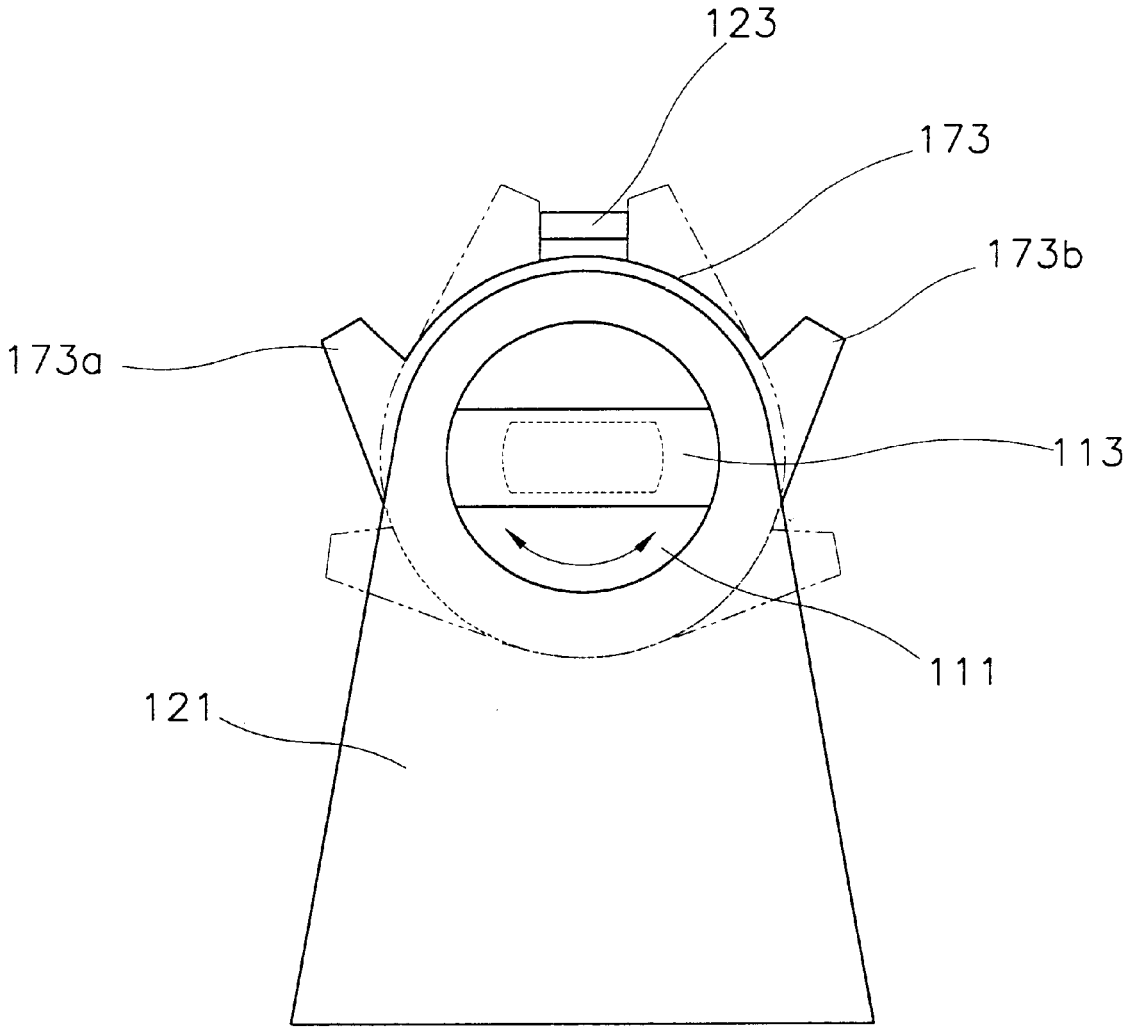
FIG. 8 shows a rotating state of a stopper in the hinge device of FIG. 4.
Figure 9:
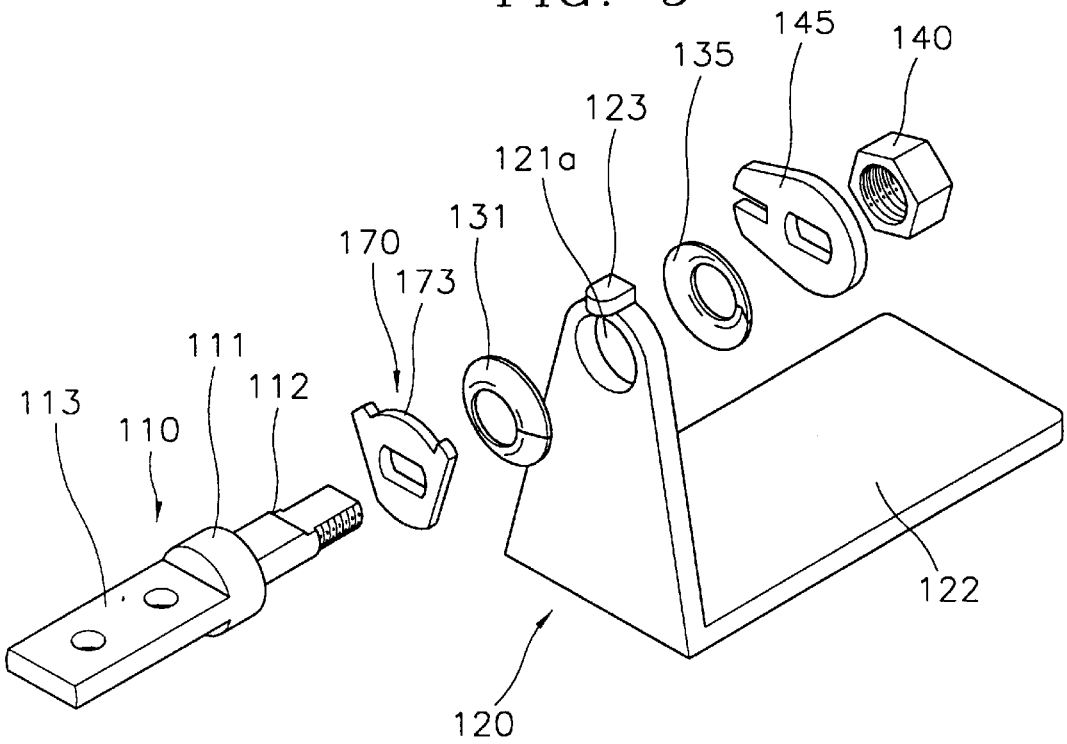
FIG. 9 is a perspective view of a second embodiment of the hinge device according to the present invention.
Figure 10:
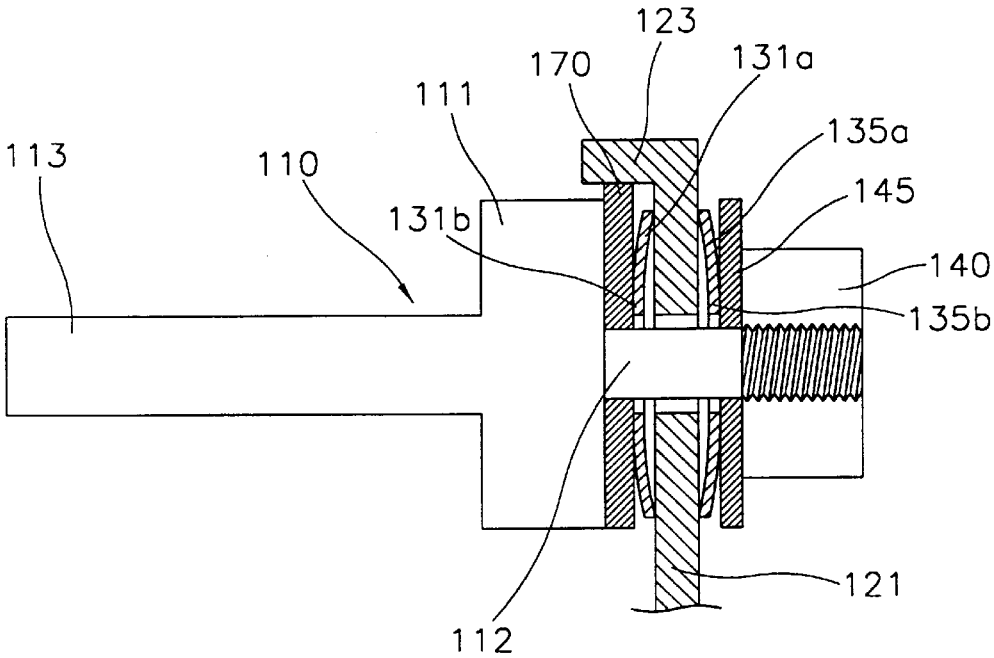
FIG. 10 is a sectional view showing a part of the hinge device of FIG. 9.

A second embodiment of the hinge device according to the present invention will be described with reference to FIGS. 9 and 10. The members having the same reference numerals as those of the members of FIGS. 4 and 8 perform the same functions and thus detailed descriptions thereof will be omitted. The second embodiment is different from the first embodiment in that, as shown in FIG. 9, only one spring is provided at either side of the supporting portion 120. In the first embodiment, two springs are installed on each side of the supporting portion 120. However, in the present embodiment, only one spring is installed on each side of the supporting portion 120.

As mentioned above, in the hinge device according to the present invention, it is not necessary to employ washers having through holes in which oil lubricant is received. Accordingly, it is possible to simplify the overall structure and to omit a process in the assembly of the washers.

Also, since the supporting portion is subjected to an elastic force by the first and second springs elastically transformed in the longitudinal direction of the shaft and a frictional torque for suppressing the rotation of the supporting portion with respect to the shaft between the shaft and the supporting portion, it is possible to prevent the supporting portion from easily rotating to an undesired position due to a small external force.

What is claimed is:

1. A hinge device comprising:

a shaft portion having a fixing portion at one end thereof, a shaft at another end thereof, and a flange therebetween, said shaft and said flange each having a respective diameter, which said diameter is smaller than that of the flange;

a supporting portion comprised of a shaft receiving portion and a fixing portion, said shaft receiving portion including a hole receiving rotatably therein the shaft of said shaft portion;

a stopper for restricting a degree of rotation of the shaft portion, said stopper having a throughhole therein for receiving said shaft therethrough, said stopper rotatably coupled to said shaft;

a nut and a washer combination received on said shaft, preventing said shaft from withdrawal out of said hole of said shaft receiving portion;

a first spring portion applying an elastic force against the supporting portion, said first spring located between the flange and the supporting portion; and a second spring to apply elastic force against the supporting portion and said washer to prevent the nut from being loosened, said second spring located between the nut and the supporting portion.

2. The hinge device of claim 1, wherein the first and second springs are of a convex shape having a planar portion formed in a center and an edge portion curved away from the planar portion.

3. The hinge device of claim 1, each spring is comprised of a respective pair of springs, wherein an oil lubricant is received between each pair of the first and second springs.

4. The hinge device of claim 1, wherein a stopper protrusion is formed on the rotating portion of the supporting portion, and wherein, the stopper includes a groove delimited by a pair of spaced restraining portions for restricting the degree of rotation of the supporting portion relative to the shaft portion.

* * * * *